US006431264B2

(12) United States Patent
Tooyama et al.

(10) Patent No.: US 6,431,264 B2
(45) Date of Patent: Aug. 13, 2002

(54) HEAT EXCHANGER WITH FLUID-PHASE CHANGE

(75) Inventors: Tatsuya Tooyama, Obu; Yutaka Shintani, Kariya, both of (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 09/855,122

(22) Filed: May 14, 2001

(30) Foreign Application Priority Data

May 15, 2000 (JP) ..... 2000-142214

(51) Int. Cl.[7] ..... F28D 1/02; F28F 9/02

(52) U.S. Cl. ..... 165/153; 165/173

(58) Field of Search ..... 165/153, 173, 165/167, 176

(56) References Cited

U.S. PATENT DOCUMENTS 4,589,265 A * 5/1986 Nozawa ..... 165/153
4,821,531 A 4/1989 Yamauchi et al.
5,024,269 A * 6/1991 Noguchi et al. ..... 165/153
5,205,347 A * 4/1993 Hughes ..... 165/176
5,617,915 A * 4/1997 Kinugasa et al. ..... 165/176
5,701,760 A 12/1997 Torigoe et al.
6,047,769 A * 4/2000 Shimoya et al. ..... 165/176
6,230,787 B1 * 5/2001 Koga et al. ..... 165/153
6,272,881 B1 * 8/2001 Kuroyanagi et al. ..... 165/174

FOREIGN PATENT DOCUMENTS

GB 2351800 1/2001

* cited by examiner

*Primary Examiner*—Henry Bennett
*Assistant Examiner*—Tho Van Duong
(74) *Attorney, Agent, or Firm*—Harness, Dickey & Pierce, PLC

(57) ABSTRACT

In a refrigerant heat exchanger, a flow direction of refrigerant flowing through tubes in each of first and second units is opposite to that flowing through tubes in each of third and fourth heat-exchanging units arranged at upstream air sides, the flow directions of refrigerant flowing through first header tanks for distributing refrigerant into the tubes of the first and fourth units are the same, and the flow directions of refrigerant flowing through first header tanks for distributing refrigerant into the tubes of the second and third units are the same. Accordingly, even when a flow direction (flow rate) of refrigerant is small, a uniform temperature distribution of air can be obtained in the refrigerant heat exchanger.

7 Claims, 6 Drawing Sheets

HEAT EXCHANGER WITH FLUID-PHASE CHANGE

CROSS-REFERENCE TO RELATED APPLICATION

This application is related to Japanese Patent Application No. 2000-142214 filed on May 15, 2000, the contents of which are hereby incorporated by reference.

BACKGROUND OF THE INVENTION

1. Field of the Invention

The present invention relates to a heat exchanger in which a fluid flowing therein has a phase change with a heat exchange. The present invention is suitably used for an evaporator of a refrigerant cycle.

2. Description of Related Art

In a conventional evaporator described in U.S. Pat. No. 5,701,760, plural heat-exchanging portions are arranged in an air flowing direction, a separator is disposed at an approximate center position in each heat exchanging portion, and a downstream-air side lower tank is communicated with an upstream-air side upper tank through a communication path. However, when a flow amount (flow rate) of refrigerant flowing through the evaporator becomes smaller, liquid refrigerant flows in each heat exchanging portion to have approximately a distribution shown in FIG. 8A, and non-cooled portions A are overlapped in the air flowing direction as shown in FIG. 8B. Accordingly, in this case, temperature of air passing through the evaporator becomes nonuniform.

SUMMARY OF THE INVENTION

In view of the foregoing problems, it is an object of the present invention to provide a heat exchanger where a fluid flowing therein has a phase change by performing a heat exchange with air. In the heat exchanger, a temperature distribution of air passing through the heat exchanger can be made uniform even when a flow amount (flow rate) of refrigerant flowing through the heat exchanger is small.

According to the present invention, in a heat exchanger in which a fluid flows to have a phase-change by performing a heat exchange with air passing through the heat exchanger, the heat exchanger includes a plurality of tubes through which the fluid flows in a longitudinal direction of the tubes, a plurality first header tanks for distributing and supplying refrigerant into the tubes, each of which is disposed at one end side of each tube in the longitudinal direction, and a plurality of second header tanks for collecting refrigerant from the tubes, each of which is disposed at the remainder end side of each tube in the longitudinal direction. In this heat exchanger, the tubes and the first and second header tanks construct at least first through fourth heat-exchanging units for performing a heat exchange between fluid and air. Among the first through fourth heat-exchanging units, the first heat-exchanging unit and the second heat-exchanging unit are arranged in a line in a width direction approximately perpendicular to an air flowing direction, the third heat-exchanging unit and the fourth heat-exchanging unit are arranged in a line in the width direction, the first heat-exchanging unit and the fourth heat-exchanging unit are arranged in a line in the air flowing direction, and the second heat-exchanging unit and the third heat-exchanging unit are arranged in a line in the air flowing direction. In addition, the first through the fourth heat-exchanging units are disposed in such a manner that, a flow direction of fluid flowing through the tubes of the first heat-exchanging unit is opposite to that flowing through the tubes of the fourth heat-exchanging unit, the flow direction of fluid flowing through the tubes of the second heat-exchanging unit is opposite to that flowing through the tubes of the third heat-exchanging unit, the flow direction of fluid flowing in the first header tank of the first heat-exchanging unit is the same as that flowing in the first header tank of the fourth heat-exchanging unit, and the flow direction of fluid flowing in the first header tank of the second heat-exchanging unit is the same as that flowing in the first header tank of the third heat-exchanging unit. Accordingly, cool areas, where air is readily cooled, are symmetrical in the air flowing direction, the cool area is overlapped in the air flowing direction with an non-cooled area where air is hardly cooled, and it can prevent the non-cooled areas from being overlapped in the air flowing directions even when a flow amount (flow rate) of fluid is small in the heat exchanger.

Preferably, a fluid inlet is provided in the first heat-exchanging unit at a side adjacent to the second heat-exchanging unit, a fluid outlet is provided in the fourth heat-exchanging unit at a side adjacent to the third heat-exchanging unit, and the first through fourth heat-exchanging units are disposed in such a manner that refrigerant flows through the first heat-exchanging unit, the second heat-exchanging unit, the third heat-exchanging unit and the fourth heat exchanging unit, in this order. Accordingly, the structure of the heat exchanger can be made simple, and the dimension of the heat exchanger can be reduced.

BRIEF DESCRIPTION OF THE DRAWINGS

Additional objects and advantages of the present invention will be more readily apparent from the following detailed description of a preferred embodiment when taken together with the accompanying drawings, in which.

DETAILED DESCRIPTION OF THE PRESENTLY PREFERRED EMBODIMENT

Figure 1:
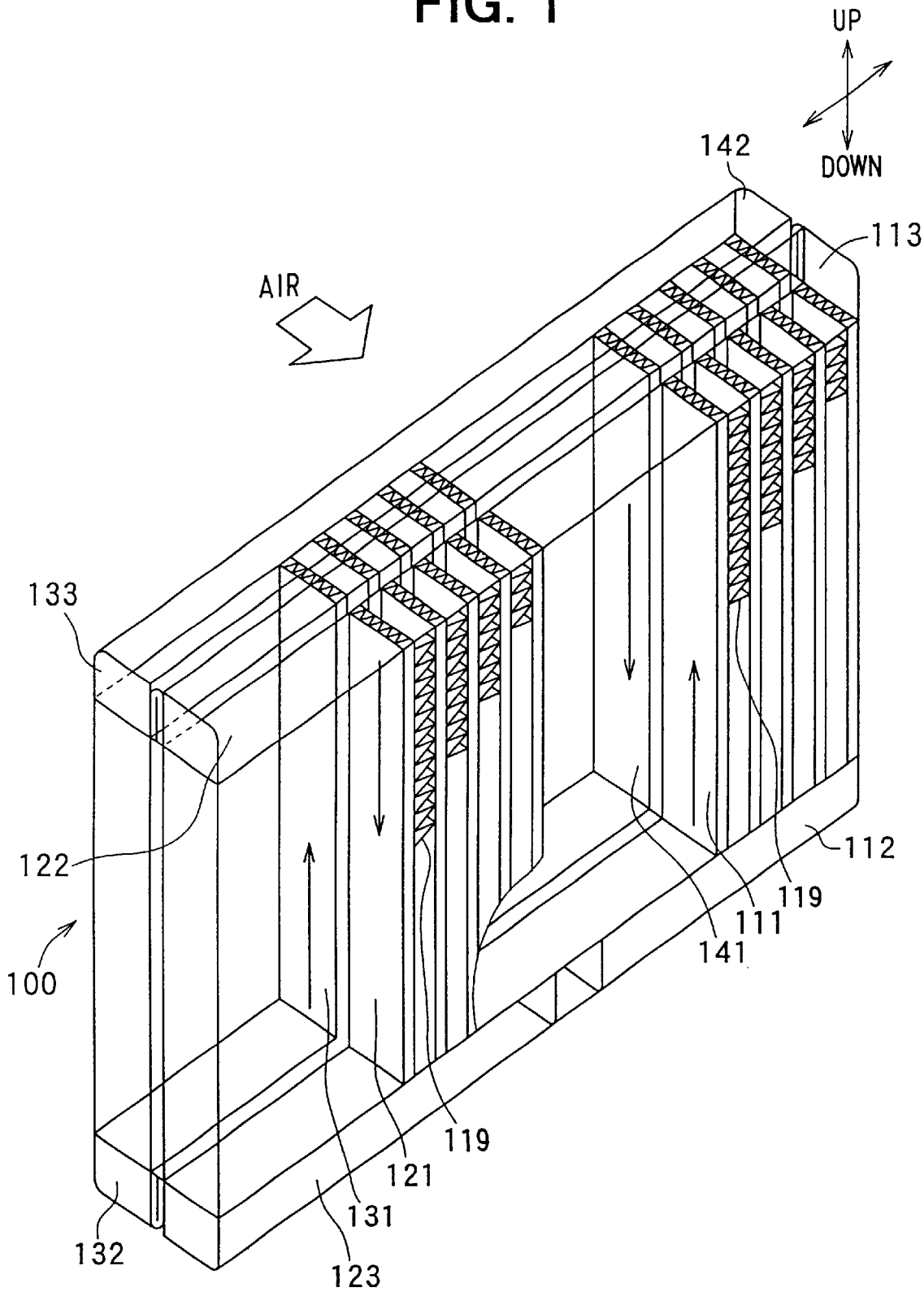
FIG. 1 is a schematic perspective view showing an evaporator according to a preferred embodiment of the present invention.

A preferred embodiment of the present invention will be described hereinafter with reference to the accompanying drawings. In this embodiment, the present invention is typically used for an evaporator of a refrigerant cycle for a vehicle air conditioner. An evaporator 100 shown in FIG. 1 is disposed in a unit case of a vehicle air conditioner, defining an air passage through which air is blown into a passenger compartment. In the evaporator 100, liquid refrigerant is evaporated by absorbing heat from air, so that air blown into the passenger compartment is cooled.

Figure 2:
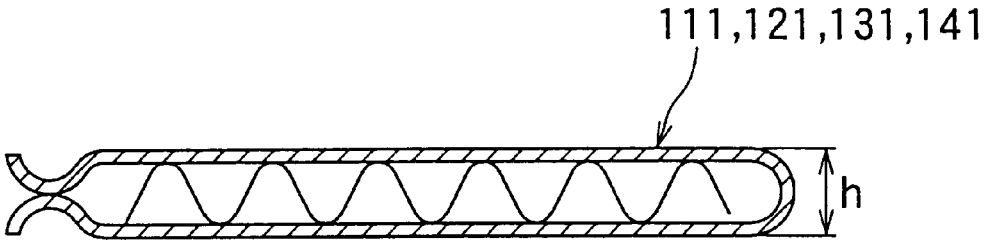
FIG. 2 is a schematic sectional view showing a tube of the evaporator according to the embodiment.

The evaporator 100 has plural tubes 111, 121, 131, 141 through which refrigerant flows in a longitudinal direction of the tubes 111, 121, 131, 141, and plural corrugated fins 119 each of which is disposed between adjacent tubes 111, 121, 131, 141 in a width direction approximately perpendicular to an air flowing direction. Each of the tubes 111, 121, 131, 141 is a flat tube, and is disposed to extend in a vertical direction. As shown in FIG. 2, a singe aluminum thin plate is bent and one end side in a major-diameter direction of the tube is bonded by brazing, so that each tube 111, 121, 131, 141 having a minor dimension "h" is formed. Wave-shaped inner fins 111*a*, 121*a*, 131*a*, 141*a* for increasing a heat-transmitting area with refrigerant are disposed in inner refrigerant passages of the tubes 111, 121, 131, 141, respectively.

At longitudinal ends of the tubes 111, 121, 131, 141, first header tanks 112, 122, 132, 142 for distributing and supplying refrigerant into the tubes 111, 121, 131, 141, respectively, are disposed to extend approximately in a horizontal direction. On the other hand, at remainder longitudinal ends of the tubes 111, 121, 131, 141 respectively opposite to the first header tanks 112, 122, 132, 142, second header tanks 113, 123, 133, 143 for collecting refrigerant from the tubes 111, 121, 131, 141 are disposed to extend approximately in the horizontal direction.

Figure 3:
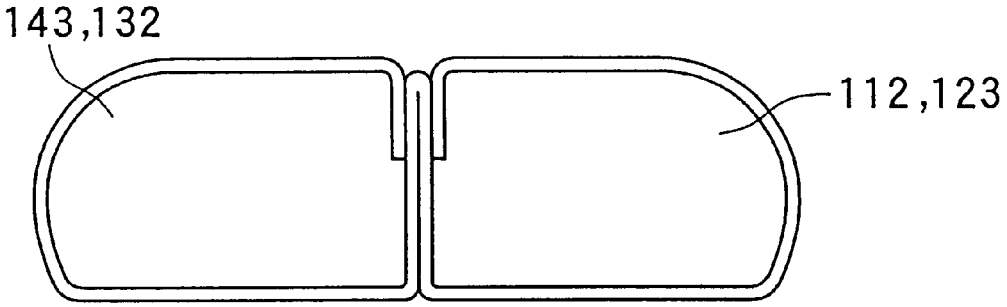
FIG. 3 is a schematic sectional view showing a header tank of the evaporator according to the embodiment.

The four header tanks 113, 122, 133, 142 positioned at the upper side ends of the tubes 111, 121, 131, 141 can be integrally formed by bending an aluminum thin plate. On the other hand, as shown in FIG. 3, among the four header tanks 112, 123, 132, 143 positioned at the lower side ends of the tubes 111, 121, 131, 141, the first header tank 112 and the second header tank 143 can be integrally formed by bending a single aluminum thin plate, and the second header tank 123 and the first header tank 132 can be integrally formed by bending a single aluminum thin plate.

Figure 4:
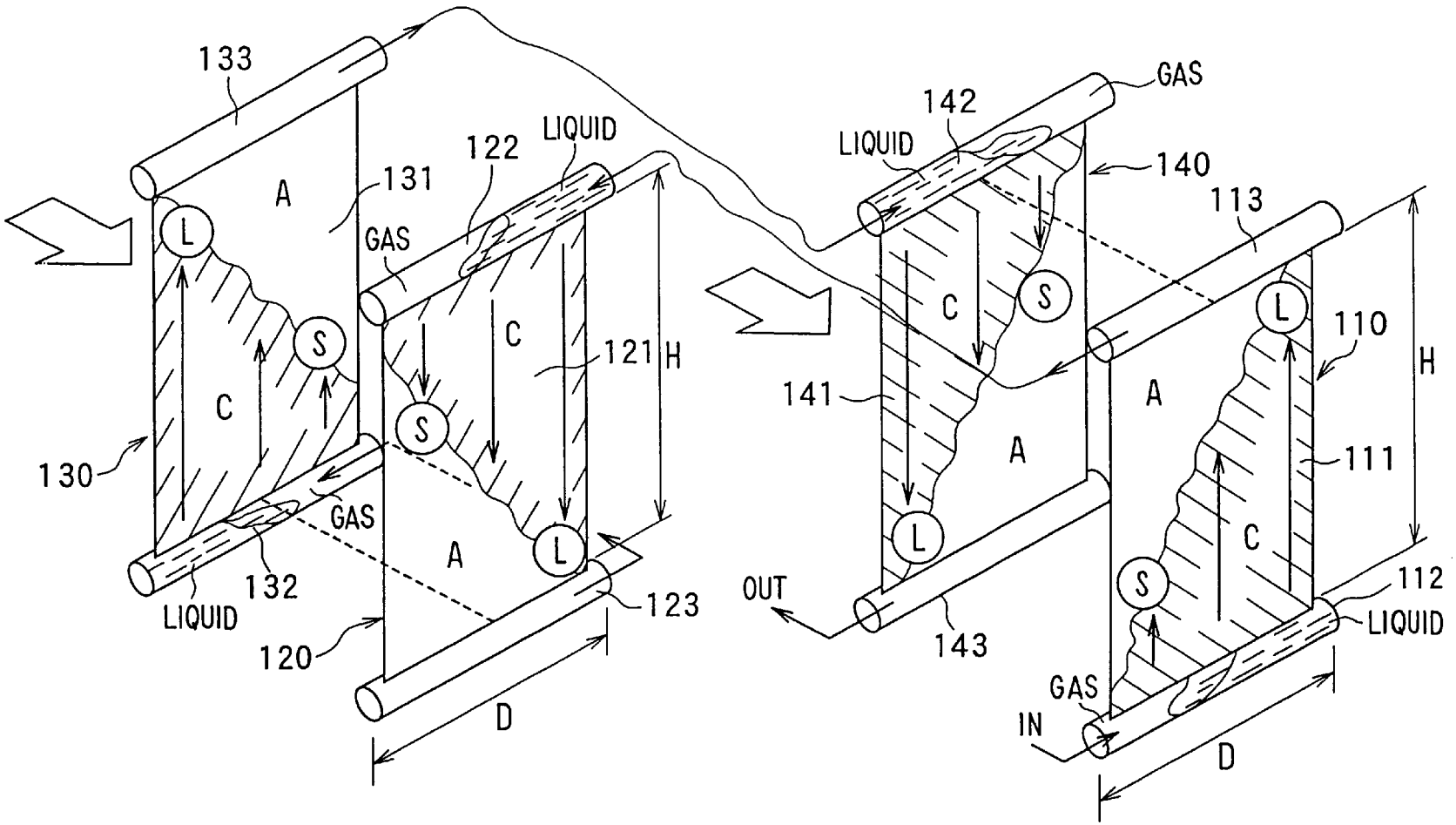
FIG. 4 is a schematic view showing refrigerant distributions in first through fourth units of the evaporator, according to the embodiment.

As shown in FIG. 4, the evaporator 100 is constructed by combining four heat exchanging units 110, 120, 130, 140. The heat exchanging unit 110 (hereinafter, referred to as first unit 110) is constructed by the tubes 111, the first header tank 112 and the second header tank 113. The heat exchanging unit 120 (hereinafter, referred to as second unit 120) is constructed by the tubes 121, the first header tank 122 and the second header tank 123. The heat exchanging unit 130 (hereinafter, referred to as third unit 130) is constructed by the tubes 131, the first header tank 132 and the second header tank 133. In addition, the heat exchanging unit 140 (hereinafter, referred to as fourth unit 140) is constructed by the tubes 141, the first header tank 142 and the second header tank 143.

The first unit 110 is arranged at a downstream air side of the fourth unit 140 so that the fourth unit 140 and the first unit 110 are arranged in a line in the air flowing direction, and the second unit 120 is arranged at a downstream air side of the third unit 130 so that the third unit 130 and the second unit 120 are arranged in a line in the air flowing direction. Further, the first unit 110 and the second unit 120 are arranged in a line in the width direction approximately perpendicular to the air flowing direction, and the third unit 130 and the fourth unit 140 are arranged in a line in the width direction.

Figure 5:
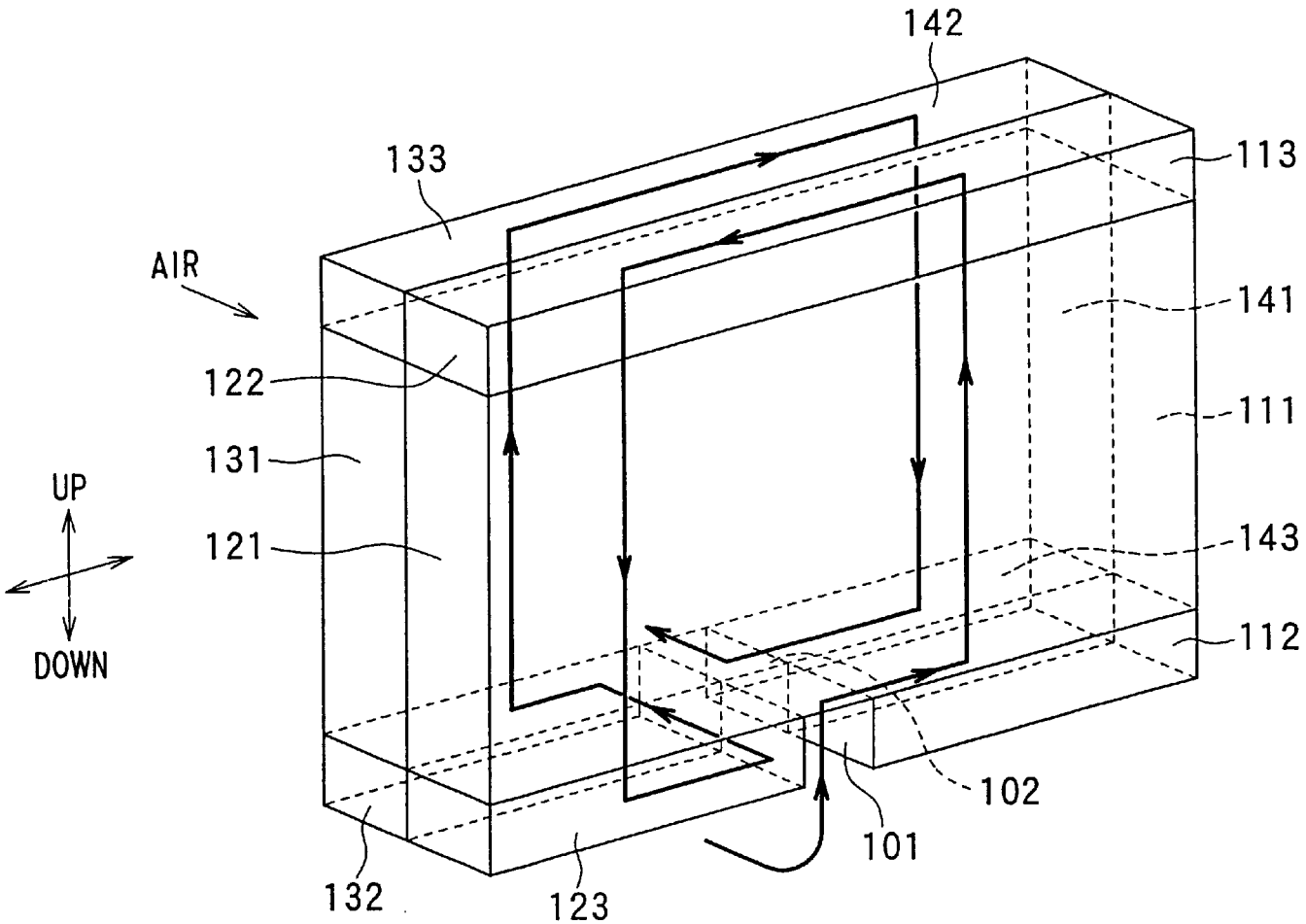
FIG. 5 is a view for explaining a refrigerant flow in the evaporator, according to the embodiment.

FIG. 5 shows a refrigerant flow in each of the first through fourth units 110, 120, 130, 140. As shown in FIG. 5, in the evaporator 100, refrigerant flows through the first unit 110, the second unit 120, the third unit 130 and the fourth unit 140, in this order. Therefore, a refrigerant inlet 101 of the evaporator 100 corresponds to a refrigerant inlet of the first unit 110, and is provided at an approximate center position in the width direction in a lower side portion of the evaporator 100. On the other hand, a refrigerant outlet 102 of the evaporator 100 corresponds to a refrigerant outlet of the fourth unit 140, and is provided at an approximate center position in the width direction in the lower side portion of the evaporator 100.

Figure 6A:
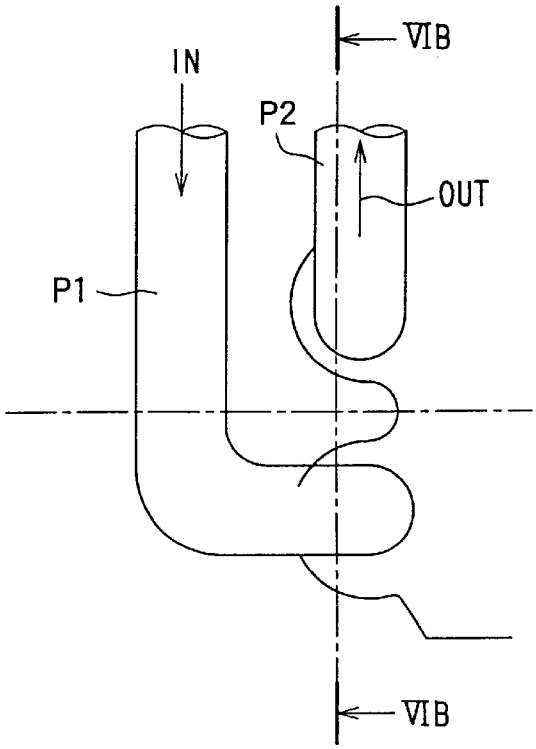
FIG. 6A is a schematic view for explaining a refrigerant inlet and a refrigerant outlet of the evaporator.
Figure 6B:
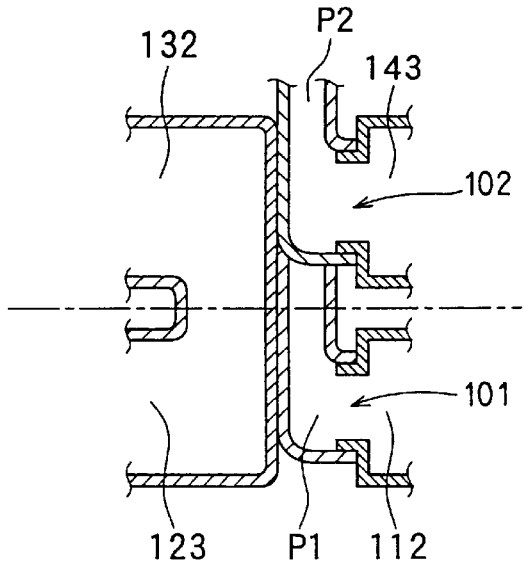
FIG. 6B is a sectional view taken a long line VIB—VIB in FIG. 6A, according to the embodiment.

As shown in FIGS. 6A and 6B, the refrigerant inlet 101 is connected to an expansion valve (not shown) by an outer pipe P1, and the refrigerant outlet 102 is connected to a suction side of a compressor (not shown) by an outer pipe P2.

In this embodiment, as shown in FIG. 4, the flow direction of refrigerant flowing through the tubes 111 of the first unit 110 is opposite to the flow direction of refrigerant flowing through the tubes 141 of the fourth unit 140, and the flow direction of refrigerant flowing through the tubes 121 of the second unit 110 is opposite to the flow direction of refrigerant flowing through the tubes 131 of the third unit 130. In addition, the flow direction of refrigerant flowing in the first header tank 112 of the first unit 110 is the same as the flow direction of refrigerant flowing in the first header tank 142 of the fourth unit 140, and the flow direction of refrigerant flowing in the first header tank 122 of the second unit 120 is the same as the flow direction of refrigerant flowing in the first header tank 132 of the third unit 130.

According to this embodiment, when a flow amount (flow rate) of refrigerant is small, in the second and fourth units 120, 140 where refrigerant flows from the first tanks 122, 142 downwardly, liquid refrigerant having a larger density readily moves downwardly as compared with gas refrigerant. Therefore, in the second and fourth units 120, 140, liquid refrigerant greatly flows in tubes 121, 141 positioned close to the refrigerant inlets of the first header tanks 122, 142, and gas refrigerant greatly flows in tubes 121, 141 as far from the inlets of the first header tanks 122, 142. Accordingly, temperature of air passing through around the tubes 121, 141 positioned close to the refrigerant inlets of the first header tanks 122, 142 becomes lower. In FIG. 4, the area "C" indicates cool area cooled by liquid refrigerant, and the area "A" indicates non-cooled area in which gas refrigerant mainly flows and air is hardly cooled. Further, in the flow arrows of the liquid refrigerant, "L" indicates a large flow of liquid refrigerant, and "S" indicates a small flow of liquid refrigerant.

As shown in FIG. 4, when a tube height of each tube 121, 141 is as H, and a tank dimension of each header tank 122, 124 is as D, the cool area C (readily cooling area) is formed in each of the second and fourth units 120, 140 into an approximate right triangle with the tube height H and the tank dimension L forming a right angle. Accordingly, the other area of an approximate right triangle is the non-cooled area A.

On the other hand, when the flow amount (flow rate) of refrigerant is small in the first and third units 110, 130 where refrigerant flows from the first tanks 112, 132 upwardly, gas refrigerant having a smaller density readily moves upwardly as compared with liquid refrigerant. Therefore, in the first and third units 110, 130, gas refrigerant greatly flows in tubes 111, 131 positioned close to the refrigerant inlets of the first header tanks 112, 132, and liquid refrigerant greatly flows in tubes 111, 131 as far from the refrigerant inlets of the first header tanks 112, 132. Accordingly, temperature of air passing through around the tubes 111, 131 positioned far from the refrigerant inlets of the first header tanks 112, 132 becomes lower, and the cool area C (readily cooling area) is formed in each of the first and third units 110, 130 into an approximate right triangle with the tube height H of the tube 111, 131 at the farthest position from the refrigerant inlets of the first header tanks 112, 132 and the tank dimension D forming a right angle. Accordingly, the other area of an approximate right triangle is the non-cooled area A in each of the first and third units 110, 130. In this embodiment, the tank dimension D in the horizontal direction can be suitably set based on a minimum refrigerant amount so that the cool area C becomes the approximate right triangle.

In the evaporator 100 according to the embodiment, the flow direction of refrigerant flowing through the tubes 111, 121 of the first and second units 110, 120 disposed at a downstream air side is opposite to the flow direction of refrigerant flowing through the tubes 131, 141 of the third and fourth units 130, 140. In addition, the flow direction of refrigerant in the first tank 112 of the first unit 110 is the same as the flow direction of refrigerant in the first tank 142 of the fourth unit 140, and the flow direction of refrigerant in the first tank 122 of the second unit 120 is the same as the flow direction of refrigerant in the first tank 132 of the third unit 130. Accordingly, in the first through fourth units 110, 120, 130, 140 of the evaporator 100, height portions of the cool areas C are symmetrical in a horizontal direction (left-right direction in FIG. 4), and bottom portions of the cool areas C are symmetrical in an up-down direction (vertical direction), so that the cool areas C are symmetrical in the air flowing direction in the evaporator 100.

Figure 7:
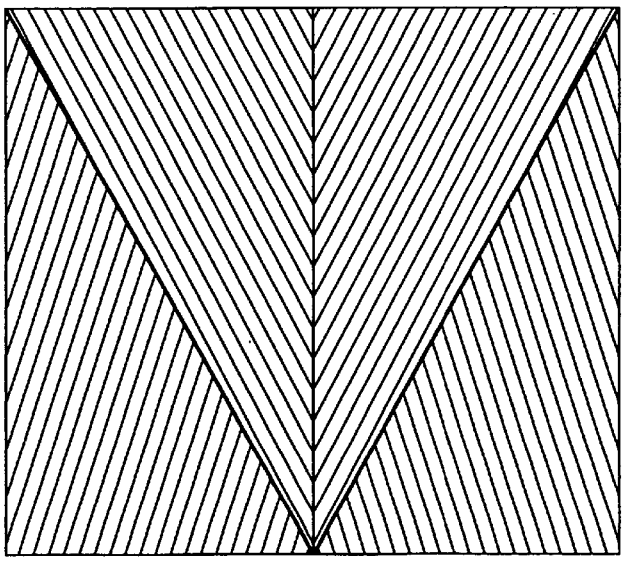
FIG. 7 is a schematic view showing liquid refrigerant distributions in the evaporator when being viewed from a downstream air side (cool air side) of the evaporator, according to the embodiment.
Figure 8A:
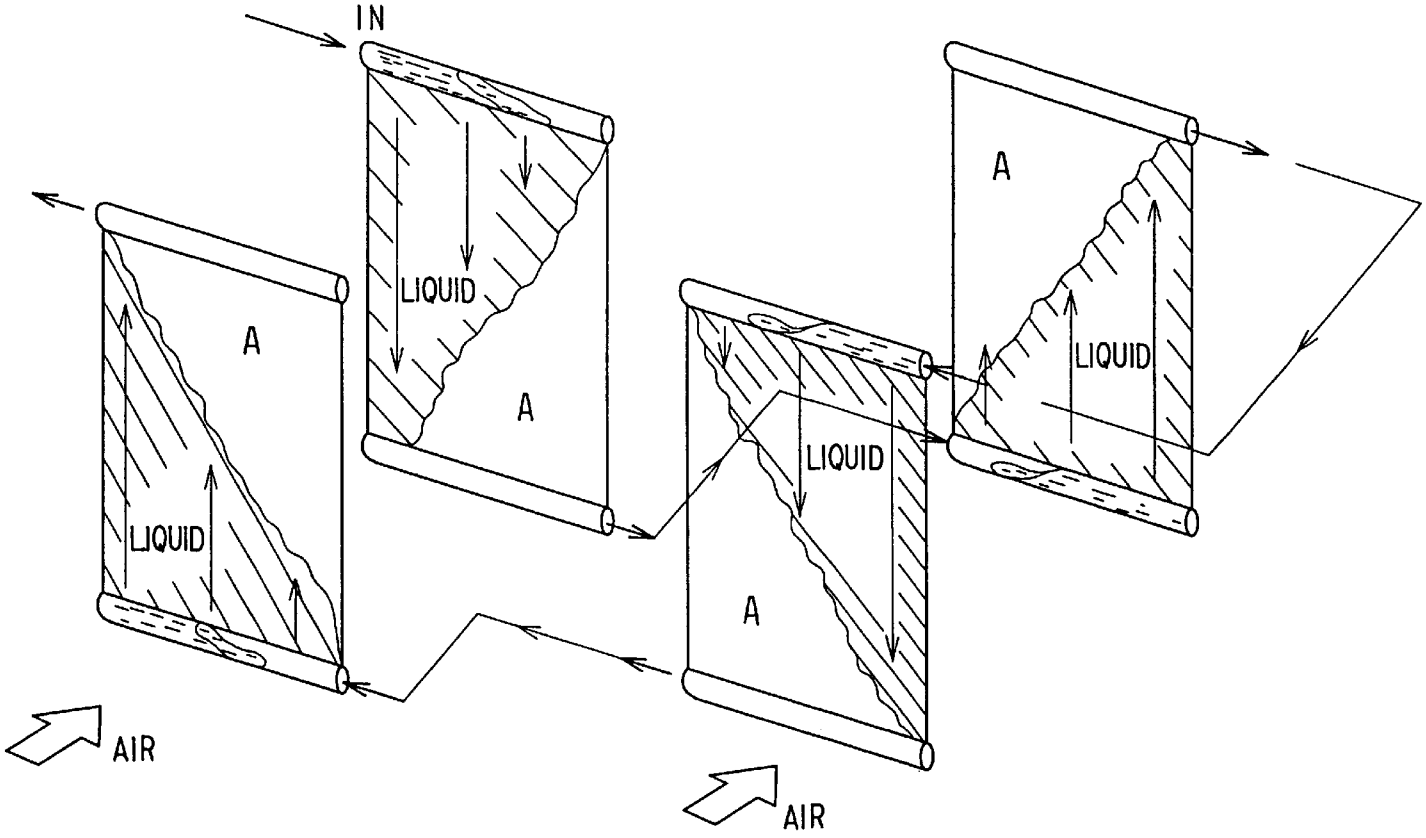
FIG. 8A PRIOR ART
FIG. 8A is a schematic view showing refrigerant distributions in first through fourth units of a conventional evaporator.
Figure 8B:
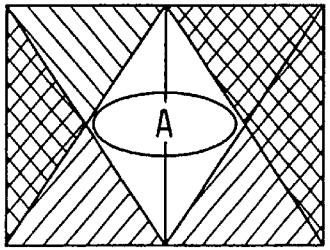
FIG. 8B PRIOR ART
FIG. 8B is a schematic view showing liquid refrigerant distributions in this conventional evaporator.

Thus, in the first through fourth units 110, 120, 130, 140 of the evaporator 100, when the cool areas C are indicated as diagonal lines and being viewed from the air flowing direction, the cool area C is overlapped with the non-cooled area A in the evaporator 100, and the distribution of the cool areas C indicated in FIG. 7 is obtained. Therefore, it can prevent the non-cool areas A from being overlapped from each other in the air flowing direction. Accordingly, even when the flow amount (flow rate) of refrigerant flowing through the evaporator 100 is small, the temperature of air passing through the evaporator 100 can be made uniform.

In this embodiment, refrigerant flowing into the first unit 110 preferentially flows into the second unit 120 which is arranged in a line with the first unit 110 in the width direction, and refrigerant flowing into the third unit 130 from the second unit 120 preferentially flows into the fourth unit 140 which is arranged in a line with the third unit 130 in the width direction. Therefore, it can prevent refrigerant dryness from being different from each other in both units arranged in the line in the width direction approximately perpendicular to the air flowing direction.

Because refrigerant preferentially flows through the first unit 110 and the second unit 120 which are arranged at the downstream air side, a temperature difference between refrigerant and air can be made larger in each of the first through fourth units 110, 120, 130, 140, and heat-exchanging efficiency can be improved in the evaporator 100.

In addition, in this embodiment, refrigerant flows into the evaporator 100 from an outside between the first and second units 110, 120, and refrigerant is discharged from the evaporator 100 to an outside between the third and fourth units 130, 140. Accordingly, the refrigerant flow of the evaporator 100 described in this embodiment can be readily obtained with simple structure, and the dimension of the evaporator 100 can be made smaller.

Although the present invention has been fully described in connection with the preferred embodiment thereof with reference to the accompanying drawings, it is to be noted that various changes and modifications will become apparent to those skilled in the art.

For example, in the above-described embodiment, the present invention is typically used for a refrigerant evaporator of a refrigerant cycle. However, the present invention may be applied to the other heat exchanger with a phase change of a fluid flowing through the heat exchanger, such as a condenser.

In the above-described embodiment, refrigerant flows into the evaporator 100 from the downstream air side unit. However, refrigerant may flows into the evaporator 100 from the upstream air side unit.

In the above-described embodiment, refrigerant flows into the evaporator 100 from between the first and second units 110, 120, and refrigerant is discharged from the evaporator 100 from between the third and fourth units 130, 140. However, the refrigerant inlet position and the refrigerant outlet position may be changed using an outer pipe and the like, while the refrigerant flow direction is made the same as described in this embodiment.

In the above-described embodiment, both units are arranged in the line in the width direction approximately perpendicular to the air flowing direction, and both unit are arranged in the line in the air flowing direction. However, plural units more than two may be arranged in the air flowing direction, or may be arranged in the width direction approximately perpendicular to the air flowing direction. For example, when three units are arranged in the air flowing direction and three units are arranged in the width direction approximately perpendicular to the air flowing direction, when any four units have the same relative position relationship and the same refrigerant flow directions as those of the above-described embodiment, the uniform temperature distribution of the present invention can be obtained. Further, the present invention may be used for a heat exchanger where plural press-formed plates having predetermined shapes are stacked on each other to form tubes and header tanks.

Such changes and modifications are to be understood as being within the scope of the present invention as defined by the appended claims.

What is claimed is:

1. A heat exchanger in which a fluid flows to have a phase-change by performing a heat exchange with air passing through the heat exchanger, the heat exchanger comprising:

a plurality of tubes through which the fluid flows in a longitudinal direction of the tubes;

a plurality of first header tanks for distributing and supplying refrigerant into the tubes, each of the first header tanks being disposed at one end side of each tube in the longitudinal direction; and a plurality of second header tanks for collecting refrigerant from the tubes, each of the second header tanks being disposed at the remainder end side of each tube in the longitudinal direction; wherein:

the tubes and the first and second header tanks construct at least first through fourth heat-exchanging units for performing a heat exchange between fluid and air;

among the first through fourth heat-exchanging units, the first heat-exchanging unit and the second heat-exchanging unit are arranged in a line in a width direction approximately perpendicular to an air flowing direction, the third heat-exchanging unit and the fourth heat-exchanging unit are arranged in a line in the width direction, the first heat-exchanging unit and the fourth heat-exchanging unit are arranged in a line in a line in the air flowing direction, and the second heat-exchanging unit and the third heat-exchanging unit are arranged in a line in the air flowing direction;

the first through fourth heat-exchanging units are constructed in such a manner that fluid flows through the first heat-exchanging unit, the second heat-exchanging unit, the third heat-exchanging unit and the fourth heat-exchanging unit, in this order; and the first through the fourth heat-exchanging units are disposed in such a manner that, a flow direction of fluid flowing through the tubes of the first heat-exchanging unit is opposite to that flowing through the tubes of the fourth heat-exchanging unit, the flow direction of fluid flowing through the tubes of the second heat-exchanging unit is opposite to that flowing through the tubes of the third heat-exchanging unit, the flow direction of fluid flowing in the first header tank of the first heat-exchanging unit is the same as that flowing in the first header tank of the fourth heat-exchanging unit, and the flow direction of fluid flowing in the first header tank of the second heat-exchanging unit is the same as that flowing in the first header tank of the third heat-exchanging unit.

2. The heat exchanger according to claim 1, wherein:

each of the tubes is disposed to extend in a vertical direction; and each of the first and second header tanks is disposed to extend approximately in a horizontal direction perpendicular to the vertical direction.

3. The heat exchanger according to claim 1, wherein the first heat-exchanging unit and the second heat-exchanging unit are disposed at downstream air sides of the fourth heat-exchanging unit and the third heat-exchanging unit, respectively.

4. The heat exchanger according to claim 1, wherein:

the first heat-exchanging unit has a fluid inlet from which the fluid is introduced from an outer side, the fluid inlet is provided in the first heat-exchanging unit at an end side adjacent to the second heat-exchanging unit in the width direction;

the fourth heat-exchanging unit has a fluid outlet from which the fluid is discharged to an outside, the fluid outlet is provided in the fourth heat-exchanging unit at an end side adjacent to the third heat-exchanging unit in the width direction; and the second and third heat-exchanging units are disposed in such a manner that fluid from the second header tank of the second heat-exchanging unit flows into the first header tank of the third heat-exchanging unit from an end side adjacent to the fourth heat-exchanging unit in the width direction.

5. A heat exchanger according to claim 1, further comprising:

a plurality of corrugated fins each of which is disposed between adjacent tubes in the width direction.

6. The heat exchanger according to claim 1, wherein each of the first header tanks extends in the width direction so that the fluid flows through each of the first header tanks from one end toward the other end in the width direction.

7. A heat exchanger in which a fluid flows to perform a heat exchange with air passing through the heat exchanger, the heat exchanger comprising:

a plurality of tubes through which the fluid flows in a longitudinal direction of the tubes;

a plurality of first header tanks for distributing and supplying the fluid into the tubes, each of the first header tanks being disposed at one end side of each tube in the longitudinal direction; and a plurality of second header tanks for collecting the fluid from the tubes, each of the second header tanks being disposed at the remainder end side of each tube in the longitudinal direction; wherein:

the tubes and the first and second header tanks construct at least first through fourth heat-exchanging units for performing a heat exchange between the fluid and air;

among the first through fourth heat-exchanging units, the first heat-exchanging unit and the second heat-exchanging unit are arranged in a line in a width direction approximately perpendicular to an air flowing direction, the third heat-exchanging unit and the fourth heat-exchanging unit are arranged in a line in the width direction, the first heat-exchanging unit and the fourth heat-exchanging unit are arranged in a line in the air flowing direction, and the second heat-exchanging unit and the third heat-exchanging unit are arranged in a line in the air flowing direction;

each of the first header tanks extends in the width direction so that the fluid flows through each of the first header tanks from one end toward the other end in the width direction;

the first heat-exchanging unit has a fluid inlet from which the fluid is introduced from an outer side, the fluid inlet is provided in the first heat-exchanging unit at a side adjacent to the second heat-exchanging unit;

the fourth heat-exchanging unit has a fluid outlet from which the fluid is discharged to an outside, the fluid outlet is provided in the fourth heat-exchanging unit at a side adjacent to the third heat-exchanging unit; and the first through fourth heat-exchanging units are disposed in such a manner that the fluid flows through the first heat-exchanging unit, the second heat-exchanging unit, the third heat-exchanging unit and the fourth heat exchanging unit, in this order.

* * * * *